US007977888B2

(12) United States Patent
Jin

(10) Patent No.: US 7,977,888 B2
(45) Date of Patent: Jul. 12, 2011

(54) DIRECT COUPLED BALANCER DRIVE FOR FLOATING LAMP STRUCTURE

(75) Inventor: Xiaoping Jin, Orange, CA (US)

(73) Assignee: Microsemi Corporation, Garden Grove, CA (US)

( * ) Notice: Subject to any disclaimer, the term of this patent is extended or adjusted under 35 U.S.C. 154(b) by 398 days.

(21) Appl. No.: 12/363,806

(22) Filed: Feb. 2, 2009

(65) Prior Publication Data

US 2009/0195175 A1 Aug. 6, 2009

Related U.S. Application Data

(63) Continuation-in-part of application No. 11/937,693, filed on Nov. 9, 2007, which is a continuation of application No. 10/959,667, filed on Oct. 5, 2004, now Pat. No. 7,294,971.

(60) Provisional application No. 61/026,227, filed on Feb. 5, 2008, provisional application No. 61/055,993, filed on May 25, 2008, provisional application No. 61/114,124, filed on Nov. 13, 2008, provisional application No. 60/508,932, filed on Oct. 6, 2003.

(51) Int. Cl.
*H05B 37/00* (2006.01)

(52) U.S. Cl. ..... 315/177; 315/276; 315/246

(58) Field of Classification Search ..... 315/177, 315/224, 246, 276, 291, 294, 312, DIG. 5
See application file for complete search history.

(56) References Cited

U.S. PATENT DOCUMENTS 2,429,162 A 10/1947 Keiser et al.
2,440,984 A 5/1948 Summers
2,572,258 A 10/1951 Goldfield et al.
2,965,799 A 12/1960 Brooks et al.
2,968,028 A 1/1961 Goto et al.
3,141,112 A 7/1964 Eppert
3,565,806 A 2/1971 Ross
3,597,656 A 8/1971 Douglas
3,611,021 A 10/1971 Wallace (Continued)

FOREIGN PATENT DOCUMENTS

EP 0326114 8/1989

(Continued)

OTHER PUBLICATIONS

Williams, B.W.; "Power Electronics Devices, Drivers, Applications and Passive Components"; Second Edition, McGraw-Hill, 1992; Chapter 10, pp. 218-249.

(Continued)

*Primary Examiner* — Don P Le
(74) *Attorney, Agent, or Firm* — Simon Kahn

(57) ABSTRACT

A backlighting arrangement constituted of a driving transformer arrangement; a plurality of lamp pairs, each of the constituent lamps of the plurality of lamp pairs exhibiting a first electrical connection and a second electrical connection; and a plurality of balancing transformers, each comprising a primary winding and a secondary winding magnetically coupled to the primary winding, and each associated with a particular one of the plurality of lamp pairs, the primary winding of each of the plurality of balancing transformers serially connected between the second electrical connections of the constituent lamps of the associated lamp pair, the secondary windings of the plurality of balancing transformers serially connected in phase, with a first end of the serially connected secondary windings of the balancing transformers connected to one phase output of the driving transformer arrangement.

21 Claims, 4 Drawing Sheets

U.S. PATENT DOCUMENTS

| | | | |
|---|---|---|---|
| 3,683,923 | A | 8/1972 | Anderson |
| 3,737,755 | A | 6/1973 | Calkin et al. |
| 3,742,330 | A | 6/1973 | Hodges et al. |
| 3,936,696 | A | 2/1976 | Gray |
| 3,944,888 | A | 3/1976 | Clark |
| 4,060,751 | A | 11/1977 | Anderson |
| 4,353,009 | A | 10/1982 | Knoll |
| 4,388,562 | A | 6/1983 | Josephson |
| 4,441,054 | A | 4/1984 | Bay |
| 4,463,287 | A | 7/1984 | Pitel |
| 4,523,130 | A | 6/1985 | Pitel |
| 4,562,338 | A | 12/1985 | Okami |
| 4,567,379 | A | 1/1986 | Corey et al. |
| 4,572,992 | A | 2/1986 | Masaki |
| 4,574,222 | A | 3/1986 | Anderson |
| 4,622,496 | A | 11/1986 | Dattilo et al. |
| 4,630,005 | A | 12/1986 | Clegg et al. |
| 4,663,566 | A | 5/1987 | Nagano |
| 4,663,570 | A | 5/1987 | Luchaco et al. |
| 4,672,300 | A | 6/1987 | Harper |
| 4,675,574 | A | 6/1987 | Delflache |
| 4,686,615 | A | 8/1987 | Ferguson |
| 4,698,554 | A | 10/1987 | Stupp et al. |
| 4,700,113 | A | 10/1987 | Stupp et al. |
| 4,761,722 | A | 8/1988 | Pruitt |
| 4,766,353 | A | 8/1988 | Burgess |
| 4,780,696 | A | 10/1988 | Jirka |
| 4,847,745 | A | 7/1989 | Shekhawat et al. |
| 4,862,059 | A | 8/1989 | Tominaga et al. |
| 4,893,069 | A | 1/1990 | Harada et al. |
| 4,902,942 | A | 2/1990 | El-Hamamsy |
| 4,939,381 | A | 7/1990 | Shibata et al. |
| 5,023,519 | A | 6/1991 | Jensen |
| 5,030,887 | A | 7/1991 | Guisinger |
| 5,036,255 | A | 7/1991 | McKnight et al. |
| 5,057,808 | A | 10/1991 | Dhyanchand |
| 5,173,643 | A | 12/1992 | Sullivan et al. |
| 5,349,272 | A | 9/1994 | Rector |
| 5,434,477 | A | 7/1995 | Crouse et al. |
| 5,475,284 | A | 12/1995 | Lester et al. |
| 5,485,057 | A | 1/1996 | Smallwood et al. |
| 5,519,289 | A | 5/1996 | Katyl et al. |
| 5,539,281 | A | 7/1996 | Shackle et al. |
| 5,557,249 | A | 9/1996 | Reynal |
| 5,563,473 | A | 10/1996 | Mattas et al. |
| 5,574,335 | A | 11/1996 | Sun |
| 5,574,356 | A | 11/1996 | Parker |
| 5,615,093 | A | 3/1997 | Nalbant |
| 5,619,402 | A | 4/1997 | Lin |
| 5,621,281 | A | 4/1997 | Kawabata et al. |
| 5,652,479 | A | 7/1997 | LoCascio et al. |
| 5,712,776 | A | 1/1998 | Palara et al. |
| 5,754,012 | A | 5/1998 | LoCascio et al. |
| 5,818,172 | A | 10/1998 | Lee |
| 5,822,201 | A | 10/1998 | Kijima |
| 5,825,133 | A | 10/1998 | Conway |
| 5,828,156 | A | 10/1998 | Roberts |
| 5,854,617 | A | 12/1998 | Lee et al. |
| 5,892,336 | A | 4/1999 | Lin et al. |
| 5,910,713 | A | 6/1999 | Nishi et al. |
| 5,912,812 | A | 6/1999 | Moriarty, Jr. |
| 5,914,842 | A | 6/1999 | Sievers |
| 5,923,129 | A | 7/1999 | Henry |
| 5,930,121 | A | 7/1999 | Henry |
| 5,930,126 | A | 7/1999 | Griffin et al. |
| 5,936,360 | A | 8/1999 | Kaneko |
| 6,002,210 | A | 12/1999 | Nilssen |
| 6,020,688 | A | 2/2000 | Moisin |
| 6,028,400 | A | 2/2000 | Pol et al. |
| 6,037,720 | A | 3/2000 | Wong et al. |
| 6,038,149 | A | 3/2000 | Hiraoka et al. |
| 6,040,662 | A | 3/2000 | Asayama |
| 6,043,609 | A | 3/2000 | George et al. |
| 6,049,177 | A | 4/2000 | Felper |
| 6,072,282 | A | 6/2000 | Adamson |
| 6,104,146 | A | 8/2000 | Chou et al. |
| 6,108,215 | A | 8/2000 | Kates et al. |
| 6,114,814 | A | 9/2000 | Shannon et al. |
| 6,121,733 | A | 9/2000 | Nilssen |
| 6,127,785 | A | 10/2000 | Williams |
| 6,127,786 | A | 10/2000 | Moisin |
| 6,137,240 | A | 10/2000 | Bogdan |
| 6,150,772 | A | 11/2000 | Crane |
| 6,169,375 | B1 | 1/2001 | Moisin |
| 6,181,066 | B1 | 1/2001 | Adamson |
| 6,181,083 | B1 | 1/2001 | Moisin |
| 6,181,084 | B1 | 1/2001 | Lau |
| 6,188,553 | B1 | 2/2001 | Moisin |
| 6,198,234 | B1 | 3/2001 | Henry |
| 6,198,236 | B1 | 3/2001 | O'Neill |
| 6,215,256 | B1 | 4/2001 | Ju |
| 6,218,788 | B1 | 4/2001 | Chen et al. |
| 6,259,615 | B1 | 7/2001 | Lin |
| 6,281,636 | B1 | 8/2001 | Okutsu et al. |
| 6,281,638 | B1 | 8/2001 | Moisin |
| 6,307,765 | B1 | 10/2001 | Choi |
| 6,310,444 | B1 | 10/2001 | Chang |
| 6,316,881 | B1 | 11/2001 | Shannon et al. |
| 6,320,329 | B1 | 11/2001 | Wacyk |
| 6,323,602 | B1 | 11/2001 | De Groot et al. |
| 6,344,699 | B1 | 2/2002 | Rimmer |
| 6,362,577 | B1 | 3/2002 | Ito et al. |
| 6,396,722 | B2 | 5/2002 | Lin |
| 6,417,631 | B1 | 7/2002 | Chen et al. |
| 6,420,839 | B1 | 7/2002 | Chiang et al. |
| 6,433,492 | B1 | 8/2002 | Buonavita |
| 6,441,943 | B1 | 8/2002 | Roberts et al. |
| 6,445,141 | B1 | 9/2002 | Kastner et al. |
| 6,459,215 | B1 | 10/2002 | Nerone et al. |
| 6,459,216 | B1 | 10/2002 | Tsai |
| 6,469,922 | B2 | 10/2002 | Choi |
| 6,472,827 | B1 | 10/2002 | Nilssen |
| 6,472,876 | B1 | 10/2002 | Notohamiprodjo et al. |
| 6,486,618 | B1 | 11/2002 | Li |
| 6,494,587 | B1 | 12/2002 | Shaw et al. |
| 6,501,234 | B2 | 12/2002 | Lin et al. |
| 6,509,696 | B2 | 1/2003 | Bruning et al. |
| 6,515,427 | B2 | 2/2003 | Oura et al. |
| 6,515,881 | B2 | 2/2003 | Chou et al. |
| 6,522,558 | B2 | 2/2003 | Henry |
| 6,531,831 | B2 | 3/2003 | Chou et al. |
| 6,534,934 | B1 | 3/2003 | Lin et al. |
| 6,559,606 | B1 | 5/2003 | Chou et al. |
| 6,570,344 | B2 | 5/2003 | Lin |
| 6,628,093 | B2 | 9/2003 | Stevens |
| 6,633,138 | B2 | 10/2003 | Shannon et al. |
| 6,661,181 | B2 * | 12/2003 | Shin ..... 315/169.4 |
| 6,680,834 | B2 | 1/2004 | Williams |
| 6,717,371 | B2 | 4/2004 | Klier et al. |
| 6,717,372 | B2 | 4/2004 | Lin et al. |
| 6,765,354 | B2 | 7/2004 | Klien et al. |
| 6,781,325 | B2 | 8/2004 | Lee |
| 6,784,627 | B2 | 8/2004 | Suzuki et al. |
| 6,804,129 | B2 | 10/2004 | Lin |
| 6,864,867 | B2 | 3/2005 | Biebl |
| 6,870,330 | B2 | 3/2005 | Choi |
| 6,922,023 | B2 | 7/2005 | Hsu et al. |
| 6,930,893 | B2 | 8/2005 | Vinciarelli |
| 6,936,975 | B2 | 8/2005 | Lin et al. |
| 7,187,139 | B2 | 3/2007 | Jin |
| 7,411,358 | B2 | 8/2008 | Shimura |
| 7,446,485 | B2 | 11/2008 | Huang |
| 7,821,208 | B2 * | 10/2010 | Baarman et al. ..... 315/244 |
| 2001/0036096 | A1 | 11/2001 | Lin |
| 2002/0030451 | A1 | 3/2002 | Moisin |
| 2002/0097004 | A1 | 7/2002 | Chiang et al. |
| 2002/0135319 | A1 | 9/2002 | Bruning et al. |
| 2002/0140538 | A1 | 10/2002 | Yer et al. |
| 2002/0145886 | A1 | 10/2002 | Stevens |
| 2002/0171376 | A1 | 11/2002 | Rust et al. |
| 2002/0180380 | A1 | 12/2002 | Lin |
| 2002/0180572 | A1 | 12/2002 | Kakehashi et al. |
| 2002/0181260 | A1 | 12/2002 | Chou et al. |
| 2002/0195971 | A1 | 12/2002 | Qian et al. |
| 2003/0001524 | A1 | 1/2003 | Lin et al. |
| 2003/0015974 | A1 | 1/2003 | Klier et al. |
| 2003/0080695 | A1 | 5/2003 | Ohsawa |

| | | | | |
|---|---|---|---|---|
| 2003/0090913 | A1 | 5/2003 | Che-Chen et al. | |
| 2003/0117084 | A1 | 6/2003 | Stack | |
| 2003/0141829 | A1 | 7/2003 | Yu et al. | |
| 2004/0000879 | A1 | 1/2004 | Lee | |
| 2004/0032223 | A1 | 2/2004 | Henry | |
| 2004/0155596 | A1 | 8/2004 | Ushijima et al. | |
| 2004/0257003 | A1 | 12/2004 | Hsieh et al. | |
| 2004/0263092 | A1 | 12/2004 | Liu | |
| 2005/0093471 | A1 | 5/2005 | Jin | |
| 2005/0093472 | A1 | 5/2005 | Jin | |
| 2005/0093482 | A1 | 5/2005 | Ball | |
| 2005/0093483 | A1 | 5/2005 | Ball | |
| 2005/0093484 | A1 | 5/2005 | Ball | |
| 2005/0099143 | A1 | 5/2005 | Kohno | |
| 2005/0156539 | A1 | 7/2005 | Ball | |
| 2005/0162098 | A1 | 7/2005 | Ball | |
| 2005/0225261 | A1 | 10/2005 | Jin | |
| 2006/0022612 | A1 | 2/2006 | Henry | |
| 2008/0079440 | A1 * | 4/2008 | Lee et al. | 324/537 |
| 2010/0244723 | A1 * | 9/2010 | Fang et al. | 315/250 |

FOREIGN PATENT DOCUMENTS

| | | | |
|---|---|---|---|
| EP | 0587923 | | 3/1994 |
| EP | 0597661 | | 5/1994 |
| EP | 0647021 | A1 | 9/1994 |
| EP | 0838272 | A2 | 4/1998 |
| EP | 1796440 | A2 | 6/2007 |
| JP | 5-90897 | | 12/1993 |
| JP | 06168791 | A | 6/1994 |
| JP | 06181095 | A | 6/1994 |
| JP | 8-204488 | | 8/1996 |
| JP | 11238589 | A | 8/1999 |
| JP | 11305196 | A | 11/1999 |
| JP | 2000030880 | A | 1/2000 |
| JP | 2002367835 | A | 12/2002 |
| TW | 485701 | | 5/2002 |
| TW | 556860 | | 1/2003 |
| TW | 0554643 | | 9/2003 |
| TW | 200501829 | | 1/2005 |
| WO | WO 94/15444 | | 7/1994 |
| WO | WO 96/38024 | | 11/1996 |

OTHER PUBLICATIONS

Bradley, D.A., "Power Electronics" 2nd Edition; Chapman & Hall, 1995; Chapter 1, pp. 1-38.

Dubey, G. K., "Thyristorised Power Controllers"; Halsted Press, 1986; pp. 74-77.

Supplementary European Search Report for Application No. EP 04794179, dated May 15, 2007.

Examination Report for Application No. EP 04794179, dated Oct. 16, 2007.

Taiwan Examination Report for Application No. 094110958, dated Mar. 20, 2008, 9 pages.

* cited by examiner

DIRECT COUPLED BALANCER DRIVE FOR FLOATING LAMP STRUCTURE

CROSS-REFERENCE TO RELATED APPLICATIONS

This application claims priority from U.S. Provisional Patent Application Ser. No. 61/026,227 filed Feb. 5, 2008, U.S. Provisional Patent Application Ser. No. 61/055,993 filed May 25, 2008 and U.S. Provisional Patent Application Ser. No. 61/114,124 filed Nov. 13, 2008, the entire contents of all of which are incorporated herein by reference. This application is related to co-filed U.S. patent application Ser. No. 12/363,805 entitled "Arrangement Suitable for Driving Floating CCFL Based Backlight" and co-filed U.S. patent application Ser. No. 12/363,807 entitled "Balancing Arrangement with Reduced Amount of Balancing Transformers", the entire contents of each of which is incorporated herein by reference. This application is a continuation in part of pending U.S. patent application Ser. No. 11/937,693 filed Nov. 9, 2007.

BACKGROUND OF THE INVENTION

The present invention relates to the field of cold cathode fluorescent lamp based lighting and more particularly to an arrangement in which a balancing transformer is supplied at the end of the lamp physically removed from the driving transformer.

Fluorescent lamps are used in a number of applications including, without limitation, backlighting of display screens, televisions and monitors. One particular type of fluorescent lamp is a cold cathode fluorescent lamp (CCFL). Such lamps require a high starting voltage (typically on the order of 700 to 1,600 volts) for a short period of time to ionize a gas contained within the lamp tubes and fire or ignite the lamp. This starting voltage may be referred to herein as a strike voltage or striking voltage. After the gas in a CCFL is ionized and the lamp is fired, less voltage is needed to keep the lamp on.

In liquid crystal display (LCD) applications, a backlight is needed to illuminate the screen so as to make a visible display. Backlight systems in LCD or other applications typically include one or more CCFLs and an inverter system to provide both DC to AC power conversion and control of the lamp brightness. Even brightness across the panel and clean operation of inverters with low switching stresses, low EMI, and low switching losses is desirable.

The lamps are typically arranged with their longitudinal axis proceeding horizontally. In general, even brightness involves two dimensions: uniform brightness in the vertical dimension, i.e. among the various lamps; and uniform brightness along the longitudinal axis of each of the various lamps in the horizontal dimension. Brightness uniformity in the vertical dimension is largely dependent on matching the lamp currents which normally requires a certain type of balancing technique to maintain an even lamp current distribution. U.S. Pat. No. 7,242,147 issued Jul. 10, 2007 to Jin, entitled "Current Sharing Scheme for Multiple CCFL Lamp Operation", the entire contents of which is incorporated herein by reference, is addressed to a ring balancer comprising a plurality of balancing transformers which facilitate current sharing in a multi-lamp backlight system thus providing even lamp current distribution. The lamps are directly connected, either individually or in pairs, across the power supply.

Brightness uniformity in the horizontal dimension is impacted by the existence of parasitic capacitance between the CCFLs and the chassis. As a result of the parasitic capacitance, leakage current exists along the length of the lamps and such leakage further results in diminishing brightness along the lamps' longitudinal axis towards the cold end in a single ended drive architecture. The term single ended drive architecture refers to a backlight arrangement in which the high voltage drive power is applied from only one side of the lamp, which is usually called the 'hot' end, and the other side of the lamp is normally at ground potential and referred as the 'cold' end. With the increasing size of LCD televisions and monitors, increases in lamp length, wire length and operating voltage associated with the resultant large backlighting systems make the leakage effect more significant, and consequently uniform horizontal brightness across lamps arranged in a single ended drive architecture is more difficult to achieve. In order to obtain even horizontal brightness for each of the CCF lamps, i.e. that the lamps should not exhibit a light gradient along its longitudinal axis, energy has to be alternatively driven into each end of the lamp. Thus, most large backlight inverter systems are configured to support 'floating' lamp structures, in which both lamp terminals are connected to a high voltage driving source, with a 180° phase shift with respect to each other, and arranged to be floating in relation to the chassis ground plane.

As described above, a factor in achieving even brightness over a CCFL is the ability to symmetrically power the lamp alternatively at both ends. This is more difficult to achieve as the length of the lamp increases. Among the conventional inverter topologies, a phase shifted full-bridge topology and a resonant full-bridge topology are most commonly used for CCFL inverter applications because of their ability to produce symmetric lamp current waveforms and clean switching operations.

U.S. Pat. No. 7,187,139 issued Mar. 6, 2007 to Jin, entitled "Split Phase Inverters for CCFL Backlight System", the entire contents of which is incorporated herein by reference, is addressed to an inverter arrangement in which the switching elements are split into two inverter arms that are deployed at separate terminals of a floating lamp structure. Such a concept provides even brightness across the longitudinal dimension of the lamps with lower cost compared with the conventional approach of deploying a full bridge circuit at each end of the lamps, while maintaining the advantages of soft switching operation of the full bridge. Unfortunately, separate inverter circuits are still needed to develop driving power at both ends of the lamp.

SUMMARY OF THE INVENTION

Accordingly, in view of the discussion above, it is a principal object of the present embodiments to overcome at least some of the disadvantages of prior art. This is provided in certain embodiments by a backlighting arrangement in which a single balancing transformer is provided for each pair of lamps, the primary winding of each of the balancing transformers being arranged to be serially connected between the individual lamps of the respective pair of lamps. The secondary windings of the balancing transformers are connected in series, with a first end of the series arrangement being coupled to one lead of a driving transformer arrangement providing a high voltage alternating current. In one embodiment the lamp pairs are constituted of linear lamps, one side of the linear lamps being connected to a driving transformer and physically located nearby, the balancing transformers being connected at the side of the lamps removed from the driving transformer.

Certain embodiments provide for a backlighting arrangement comprising: a driving transformer arrangement exhibiting a first output lead and a second output lead, the first output lead and the second output lead of the driving transformer arrangement exhibiting opposing phases; a plurality of lamp pairs, each of the constituent lamps of the plurality of lamp pairs exhibiting a first electrical connection and a second electrical connection; and a plurality of balancing transformers, each comprising a primary winding and a secondary winding magnetically coupled to the primary winding, and each associated with a particular one of the plurality of lamp pairs, the primary winding of each of the plurality of balancing transformers being serially connected between the second electrical connections of the constituent lamps of the associated lamp pair, wherein the secondary windings of the plurality of balancing transformers are serially connected in phase, with a first end of the serially connected secondary windings of the balancing transformers connected to the first output lead of the driving transformer arrangement, and the first electrical connection of at least one of the constituent lamps of each of the plurality of lamp pairs connected to the second output lead of the driving transformer arrangement.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
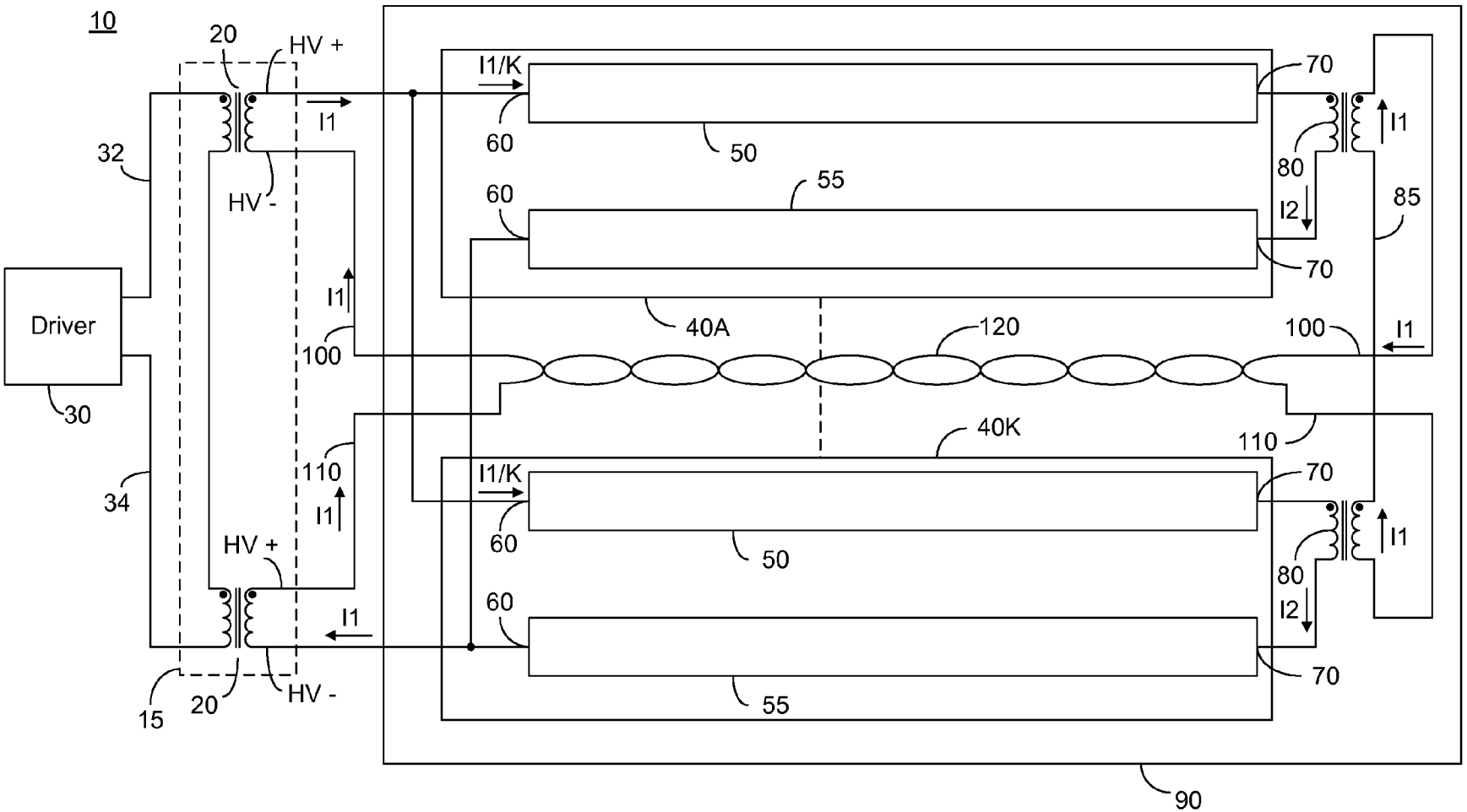
FIG. 1 illustrates a high level block diagram of an exemplary embodiment of a backlighting arrangement comprising a pair of driving transformers whose primaries are serially connected, the ends of the serially connected primaries being coupled to opposing phases of a driver.

The present embodiments enable a backlighting arrangement in which a single balancing transformer is provided for each pair of lamps, the primary winding of each of the balancing transformers being arranged to be serially connected between the individual lamps of the respective pair of lamps. The secondary windings of the balancing transformers are connected in series, with a first end of the series arrangement being coupled to one lead of a driving transformer secondary winding arranged to provide a high voltage alternating current. In one embodiment the lamp pairs are constituted of linear lamps, one side of the linear lamps being connected to a driving transformer and physically located nearby, the balancing transformers being connected at the side of the lamps removed from the driving transformer.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting. The term connected as used herein is not meant to be limited to a direct connection, and the use of appropriate resistors, capacitors and inductors does not exceed the scope thereof.

FIG. 1 illustrates a high level block diagram of an exemplary backlighting arrangement 10 comprising: a driving transformer arrangement 15 constituted of a pair of driving transformers 20 whose primary windings are serially connected, the ends of the serially connected primary windings being coupled to opposing phases of a driver 30, denoted respectively 32 and 34. Backlighting arrangement 10 further comprises: a plurality a lamp pairs 40A . . . 40K, generally lamp pair 40, each constituted of a first lamp 50 and a second lamp 55; and a plurality of balancing transformers 80, each associated with a particular lamp pair 40. Each of first lamp 50 and second lamp 55 exhibits a respective first connection 60 and a respective second connection 70. Lamp pairs 40 are arranged to provide a backlight for a display 90. In certain embodiments, first lamp 50 and second lamp 55 are linear lamps, preferably of like constituency. In certain embodiments driver 30 is constituted of a DC/AC inverter. In one particular embodiment, lamp pairs 40 are floating in relation to a chassis, and driving transformers 20 are arranged on only one side of lamp pairs 40 which are arranged in a parallel configuration.

Each balancing transformer 80 comprises a primary winding and a secondary winding magnetically coupled thereto. Each driving transformer 20 comprises a primary winding and a secondary winding magnetically coupled thereto. Driving transformer 20 is preferably a step up transformer arranged to deliver a high voltage across the secondary winding responsive to a changing waveform appearing across its primary winding. Outputs 32 and 34 of driver 30 are preferably 180° out of phase with each other, thereby generating the high voltage across the secondary winding of driving transformer 20.

The secondary windings of the balancing transformers 80 are connected in series, and in phase, to form a serial string of secondary windings 85. A first end of the secondary winding of first driving transformer 20 is connected to a first end of the secondary winding of balancing transformer 80 associated with lamp pair 40A, via a connection 100, thus being connected to one end of serial string of secondary windings 85. The second end of serial string of secondary windings 85, constituted of one end of the secondary winding of balancing transformer 80 associated with lamp pair 40K, is connected to a first end of the secondary winding of second driving transformer 20, via a connection 1 10.

A second end of the secondary winding of first driving transformer 20 is connected to first connection 60 of first lamp 50 of each of the lamp pairs 40. Second connection 70 of each first lamp 50 is serially connected via the primary winding of the respective associated balancing transformer 80 to second connection 70 of the respective second lamp 55 of the lamp pair 40. A second end of the secondary winding of second driving transformer 20 is connected to first connection 60 of second lamp 55 of each of the lamp pairs 40.

Preferably, each first lamp 50 and each second lamp 55 are constituted of a linear lamp. The end of first lamp 50 and second lamp 55 associated with first connection 60 are preferably in physical proximity of driving transformer arrangement 15, e.g. on the same side of display 90 which is typically constituted of a metal based chassis as driving transformer arrangement 15, and preferably generally define a first plane. Preferably, each first lamp 50 and each second lamp 55 generally extend axially away from the proximity of driving transformer arrangement 15, and generally define a second plane preferably orthogonal to the first plane.

In operation, driver 30, which in one embodiment comprises a direct drive backlight driver as described in U.S. Pat. No. 5,930,121 issued Jul. 27, 1999 to Henry, entitled "Direct Drive Backlight System", the entire contents of which is incorporated herein by reference, provides a differential AC source via driving transformer 20. Outputs 32 and 34 are out of phase, as described above. For simplicity, the operation will be described when the electrical potential of the end of the secondary of first driving transformer 20, representing a first output of driving transformer arrangement 15, connected to first connection 60 of each of first lamps 50 is at a positive potential, denoted HV+, in relation to the end of the secondary of first driving transformer 20, denoted HV−, connected to serial string of secondary windings 85. Similarly and contemporaneously, the end of the secondary of second driving transformer 20 connected to serial string of secondary windings 85 is at a positive potential, denoted HV+, in relation to the end of the secondary of second driving transformer 20, denoted HV−, connected to first connection 60 of each of the second lamps 55 and representing a second output of driving transformer arrangement 15. It is to be understood that the above is for approximately ½ of the driving cycle, with the voltage potentials, and resultant currents, being reversed during the balance of the driving cycle.

First connection 60 of each of first lamps 50 is thus at a potential of HV+, and first connection 60 of each of second lamps 55 is thus at a potential of HV−. First lamp 50 and second lamp 55 of each lamp pair 40 are essentially connected in series across the voltage potential HV+−HV−, with the second connections 70 of each of first lamp 50 and second lamp 55 completing the circuit through the primary winding of the respective balancing transformer 80. Advantageously, preferably only connections 100 and 110 run parallel to lamp pairs 40, and as will be explained further below exhibit a balancing current. Thus, in one embodiment, connections 100 and 110 are formed of a single twisted wire pair 120 to reduce electromagnetic interference.

A current I1 is developed through the secondary winding of each of first driving transformer 20 and second driving transformer 20. A portion of the developed current I1 is driven into first connection 60 of each first lamp 50 from the secondary winding of first driving transformer 20, and current I1 is returned via serial string of secondary windings 85 and connection 100. The developed current I1 from second driving transformer 20 is driven via connection 110 into serial string of secondary windings 85 and is returned from first connection 60 of second lamps 55. Current I1 flowing through the secondary of each balancing transformer 80 generates a current I2 flowing through the primary of each balancing transformer 80 aligned in the direction of current flow I1 through each first lamp 50 and second lamp 55.

The turns ratio for each of the balancing transformers 80 is preferably determined responsive to the number of lamp pairs 40. Thus, assuming K lamp pairs 40, i.e. lamp pairs 40A-40K, the turns ratio between the primary windings and secondary windings of each of the balancing transformers 80 are:

$$N_{primary}/N_{secondary}=K, \quad \text{EQ. 1}$$

wherein $N_{primary}$ denotes the number of turns of the winding in the primary of each of balancing transformers 80 and $N_{secondary}$ denotes the number of turns of the winding in the secondary of each of balancing transformers 80. With the arrangement of EQ. 1, the ratio of the current in the primary and secondary windings of each of the balancing transformers 80 is:

$$I1/I2=N_{primary}/N_{secondary}=K \quad \text{EQ. 2}$$

or $$I1=K*I2 \quad \text{EQ. 3}$$

Current I1 developed by first driving transformer 20 is driven into K first lamps 50 at the respective first connection 60 during the respective half cycle. Assuming the current driven into each of first lamps 50 is equal, and thus each first lamp 50 receive I1/K current, I1 from HV+ is equal to I1 into HV− which is equal to K*I2 from EQ. 3. Current flowing in serial string of secondary windings 85 is thus K*I2 and the current in the primary windings of the balancing transformers 80 is I2 or I1/K from EQ. 3. The serial connection of secondary windings of balancing transformers 80 ensures that the current in the secondary windings of all balancing transformers 80 is equal, and further forces the current in the primary windings of all balancing transformers 80 to be equal, provided that the turns ratio of the all the balancing transformers 80 are K.

It is to be understood that since each first lamp 50 and second lamp 55 of each lamp pair 40 is connected in series via the respective balancing transformer 80 primary winding, the current of each lamp equals the balancing transformer 80 primary current, and eventually equal current of all the lamps is achieved.

Backlighting arrangement 10 further functions to drive energy from the driving transformers 20 to generate driving voltages at second connections 70 of first lamps 50 and second lamps 55 so as to obtain even illumination across the longitudinal dimension of the lamp. Since serial string of secondary windings 85 is connected to driving transformers 20, driving current I1 of the secondary of driving transformers 20 flows through the secondary windings of the balancing transformers 80, and such current stimulates magnetic flux in the core of balancing transformers 80 thereby generating driving voltages in the primary windings of each of the balancing transformers 80.

There is no requirement that the turns ratio of the balancing transformer 80 meet EQ. 1. A higher turns ratio will result in lower lamp current at the far end, i.e. the end associated with second connection 70, with the offsetting advantage that the cost of the balancing transformer 80 may be reduced. In one non-limiting example, in which the turns ratio is set to 2K, lamp current I2 at the far end is half of the respective fraction of lamp current I1 driven into each lamps hot end, i.e. the end associated with first connection 60, and advantageously a smaller core size can be chosen for balancing transformer 80. Such approach is a compromise between performance and cost. Though the far end lamp current I2 is lower than hot end lamp current I1, the uniformity of the brightness across the lamp longitudinal dimension is much better than the situation in which no active voltage at the far end is provided. It is to be noted that with large LCD panels, such as those of 46" and above, without active driving voltages at the far end, during operation the far end remains dark due to capacitive leakage to the chassis along the lamps, no matter how much voltage is applied to the hot end.

Figure 2:
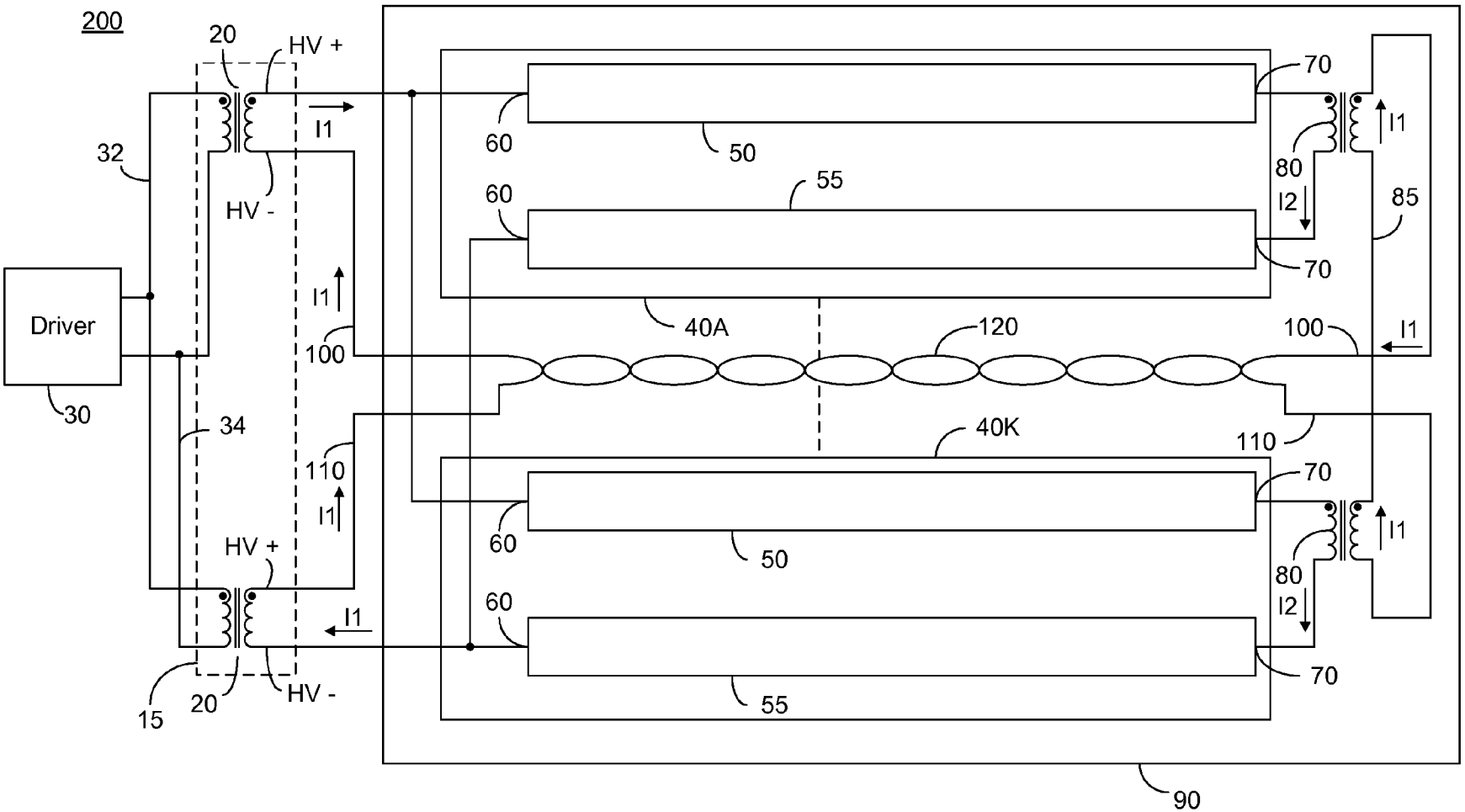
FIG. 2 illustrates a high level block diagram of an exemplary embodiment of a backlighting arrangement comprising a pair of driving transformers whose primaries are connected in parallel, the ends of each of the parallel connected primaries being coupled to opposing phases of a driver.

FIG. 2 illustrates a high level block diagram of a backlighting arrangement 200 comprising: a driving transformer arrangement 15 constituted of a pair of driving transformers 20 whose primary windings are connected in parallel, the ends of each of the parallel connected primary windings being coupled to opposing phases of a driver 30, denoted respectively 32 and 34, in accordance with certain embodiments of the invention. Backlighting arrangement 200 further comprises: a plurality a lamp pairs 40A . . . 40K, generally lamp pair 40, each constituted of a first lamp 50 and a second lamp 55; and a plurality of balancing transformers 80, each associated with a particular lamp pair 40. Each of first lamp 50 and second lamp 55 exhibits a respective first connection 60 and a respective second connection 70. Lamp pairs 40 are arranged to provide a backlight for a display 90. In certain embodiments, first lamp 50 and second lamp 55 are linear lamps, preferably of like constituency. In certain embodiments driver 30 is constituted of a DC/AC inverter. In one particular embodiment, lamp pairs 40 are floating in relation to a chassis, and driving transformers 20 are arranged on only one side of lamp pairs 40 which are arranged in a parallel configuration.

Each balancing transformer 80 comprises a primary winding and a secondary winding magnetically coupled thereto. Each driving transformer 20 comprises a primary winding and a secondary winding magnetically coupled thereto. Driving transformer 20 is preferably a step up transformer arranged to deliver a high voltage across the secondary winding responsive to changing waveform appearing across its primary winding. Outputs 32 and 34 of driver 30 are preferably 180° out of phase with each other, thereby generating the high voltage across the secondary winding of driving transformer 20.

The secondary windings of the balancing transformers 80 are connected in series, and in phase, to form a serial string of secondary windings 85. A first end of the secondary winding of first driving transformer 20, constituting a first output of driving transformer arrangement 15, is connected to a first end of the secondary winding of balancing transformer 80 associated with lamp pair 40A, via a connection 100, thus being connected to one end of serial string of secondary windings 85. The second end of serial string of secondary windings 85, constituted of one end of the secondary winding of balancing transformer 80 associated with lamp pair 40K, is connected to a first end of the secondary winding of second driving transformer 20, via a connection 110.

A second end of the secondary winding of first driving transformer 20 is connected to first connection 60 of first lamp 50 of each of the lamp pairs 40. Second connection 70 of each first lamp 50 is serially connected via the primary winding of the respective associated balancing transformer 80 to second connection 70 of the respective second lamp 55 of the lamp pair 40. A second end of the secondary winding of second driving transformer 20, constituting a second output of driving transformer arrangement 15, is connected to first connection 60 of second lamp 55 of each of the lamp pairs 40.

Preferably, each first lamp 50 and each second lamp 55 are constituted of a linear lamp. The end of first lamp 50 and second lamp 55 associated with first connection 60 are preferably in physical proximity of driving transformer arrangement 15, e.g. on the same side of display 90 which is typically constituted of a metal based chassis as driving transformer arrangement 15, and preferably generally define a first plane. Preferably, each first lamp 50 and each second lamp 55 generally extend axially away from the proximity of driving transformer arrangement 15, and generally define a second plane preferably orthogonal to the first plane.

In operation backlighting arrangement 200 operates in all respects similar to the operation of backlighting arrangement 10 of FIG. 1, with drive energy from the driving transformers 20 being supplied via serial string of secondary windings 85 to generate driving voltages at second connections 70 of first lamps 50 and second lamps 55 so as to obtain even illumination across the longitudinal dimension of the lamp. Since serial string of secondary windings 85 is connected to driving transformers 20, driving current I1 of the secondary of driving transformers 20 flows through the secondary windings of the balancing transformers 80, and such current stimulates magnetic flux in the core of balancing transformers 80 thereby generating driving voltages in the primary windings of each of the balancing transformers 80.

Figure 3:
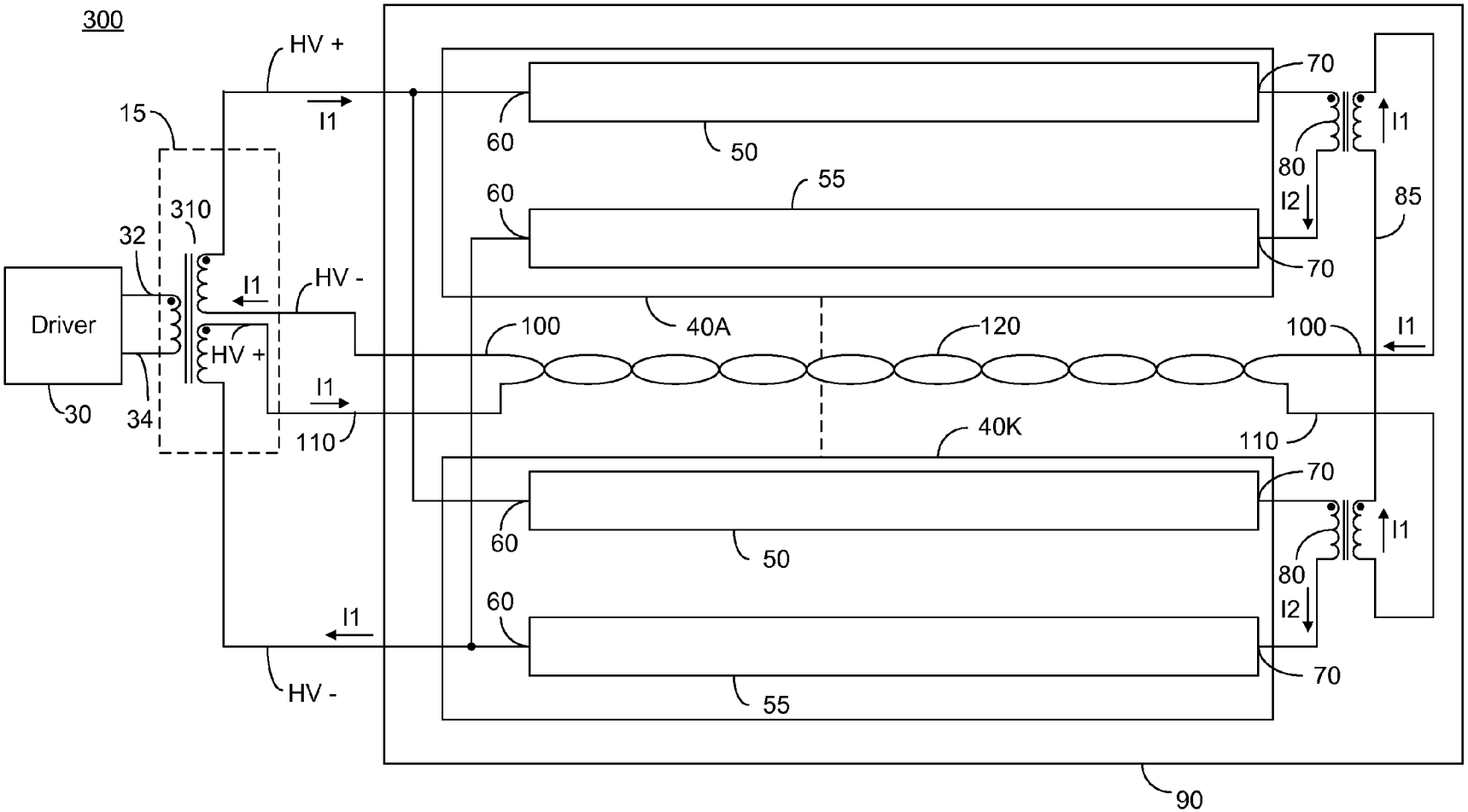
FIG. 3 illustrates a high level block diagram of an exemplary embodiment of a backlighting arrangement comprising a driving transformer exhibiting a primary winding and two secondary windings, the ends of the primary winding being coupled to opposing phases of a driver.

FIG. 3 illustrates a high level block diagram of a backlighting arrangement 300 comprising: a driving transformer arrangement 15 constituted of a driving transformer 310 having a primary and a pair of secondary windings magnetically coupled to the primary winding. The ends of the primary winding of driving transformer 310 are coupled to opposing phases of a driver 30, denoted respectively 32 and 34, in accordance with certain embodiments of the invention. Backlighting arrangement 300 further comprises: a plurality a lamp pairs 40A . . . 40K, generally lamp pair 40, each constituted of a first lamp 50 and a second lamp 55; and a plurality of balancing transformers 80, each associated with a particular lamp pair 40. Each of first lamp 50 and second lamp 55 exhibits a respective first connection 60 and a respective second connection 70. Lamp pairs 40 are arranged to provide a backlight for a display 90. In certain embodiments, first lamp 50 and second lamp 55 are linear lamps, preferably of like constituency. In certain embodiments driver 30 is constituted of a DC/AC inverter. In one particular embodiment, lamp pairs 40 are floating in relation to a chassis, and driving transformer 310 is arranged on only one side of lamp pairs 40 which are arranged in a parallel configuration.

Each balancing transformer 80 comprises a primary winding and a secondary winding magnetically coupled thereto. Driving transformer 310 is preferably a step up transformer arranged to deliver a high voltage across the secondary windings responsive to changing waveform appearing across its primary winding. Outputs 32 and 34 of driver 30 are preferably 180° out of phase with each other, thereby generating the high voltage across the secondary winding of driving transformer 20.

The secondary windings of the balancing transformers 80 are connected in series, and in phase, to form a serial string of secondary windings 85. A first end of the first secondary winding of driving transformer 310, constituting a first output of driving transformer arrangement 15, is connected to a first end of the secondary winding of balancing transformer 80 associated with lamp pair 40A, via a connection 100, thus being connected to one end of serial string of secondary windings 85. The second end of serial string of secondary windings 85, constituted of one end of the secondary winding of balancing transformer 80 associated with lamp pair 40K, is connected to a first end of the second secondary winding of driving transformer 310, via a connection 110.

A second end of the first secondary winding of driving transformer 310 is connected to first connection 60 of first lamp 50 of each of the lamp pairs 40. Second connection 70 of each first lamp 50 is serially connected via the primary winding of the respective associated balancing transformer 80 to second connection 70 of the respective second lamp 55 of the lamp pair 40. A second end of the second secondary winding of driving transformer 310, constituting a second output of driving transformer arrangement 15, is connected to first connection 60 of second lamp 55 of each of the lamp pairs 40.

Preferably, each first lamp 50 and each second lamp 55 are constituted of a linear lamp. The end of first lamp 50 and second lamp 55 associated with first connection 60 are preferably in physical proximity of driving transformer arrangement 15, e.g. on the same side of display 90 which is typically constituted of a metal based chassis as driving transformer arrangement 15, and preferably generally define a first plane. Preferably, each first lamp 50 and each second lamp 55 generally extend axially away from the proximity of driving transformer arrangement 15, and generally define a second plane preferably orthogonal to the first plane.

In operation backlighting arrangement 300 operates in all respects similar to the operation of backlighting arrangement 10 of FIG. 1, and backlighting arrangement 200 of FIG. 2, with drive energy from driving transformers 310 being supplied via serial string of secondary windings 85 to generate driving voltages at second connections 70 of first lamps 50 and second lamps 55 so as to obtain even illumination across the longitudinal dimension of the lamp. Since serial string of secondary windings 85 is connected to driving transformer 310, driving current I1 of the secondary windings of driving transformer 310 flows through the secondary windings of the balancing transformers 80, and such current stimulates magnetic flux in the core of balancing transformers 80 thereby generating driving voltages in the primary windings of each of the balancing transformers 80.

Figure 4:
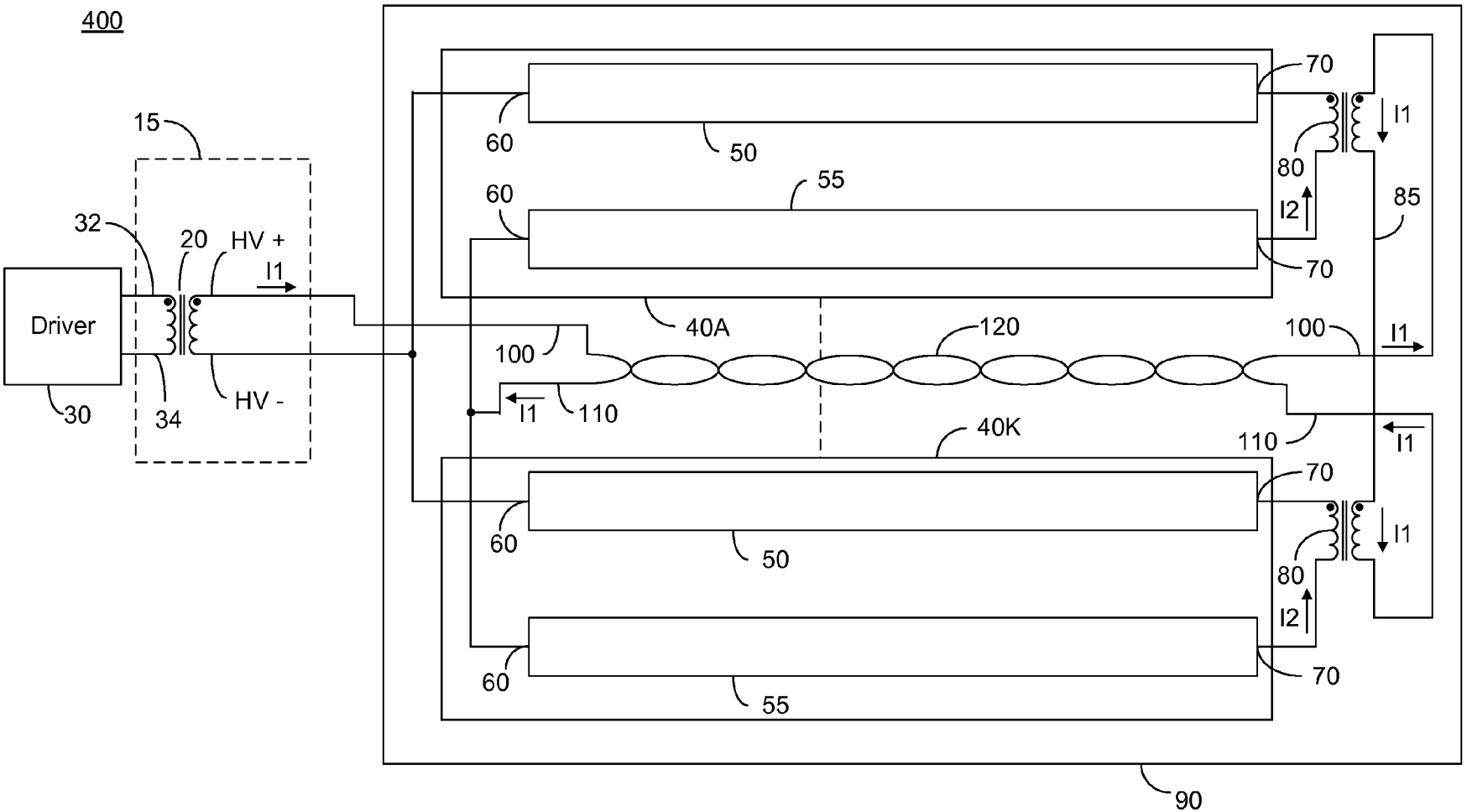
FIG. 4 illustrates a high level block diagram of an exemplary embodiment of a backlighting arrangement comprising a driving transformer exhibiting a primary winding and a secondary winding, the ends of the primary winding being coupled to opposing phases of a driver.

FIG. 4 illustrates a high level block diagram of a backlighting arrangement 400 comprising: a driving transformer arrangement 15 constituted of a driving transformer 20 having a primary and a secondary winding magnetically coupled to the primary winding. The ends of the primary winding of driving transformer 20 are coupled to opposing phases of a driver 30, denoted respectively 32 and 34, in accordance with certain embodiments of the invention. Backlighting arrangement 400 further comprises: a plurality a lamp pairs 40A . . . 40K, generally lamp pair 40, each constituted of a first lamp 50 and a second lamp 55; and a plurality of balancing transformers 80, each associated with a particular lamp pair 40. Each of first lamp 50 and second lamp 55 exhibits a respective first connection 60 and a respective second connection 70. Lamp pairs 40 are arranged to provide a backlight for a display 90. In certain embodiments, first lamp 50 and second lamp 55 are linear lamps, preferably of like constituency. In certain embodiments driver 30 is constituted of a DC/AC inverter. In one particular embodiment, lamp pairs 40 are floating in relation to a chassis, and driving transformer 20 is arranged on only one side of lamp pairs 40 which are arranged in a parallel configuration.

Each balancing transformer 80 comprises a primary winding and a secondary winding magnetically coupled thereto. Driving transformer 20 is preferably a step up transformer arranged to deliver a high voltage across the secondary winding responsive to changing waveform appearing across its primary winding. Outputs 32 and 34 of driver 30 are preferably 180° out of phase with each other, thereby generating the high voltage across the secondary winding of driving transformer 20. Driving transformer 20 is illustrated as having a single secondary winding magnetically coupled to a single primary winding, however this is not meant to be limiting in any way. Driving transformer 20 may be provided with a secondary winding arranged to drive plurality a lamp pairs 40A . . . 40K, and additional secondary windings not arranged to drive plurality a lamp pairs 40A . . . 40K without exceeding the scope.

The secondary windings of the balancing transformers 80 are connected in series, and in phase, to form a serial string of secondary windings 85. A first end of the secondary winding of driving transformer 20, constituting a first output of driving transformer arrangement 15, is connected to a first end of the secondary winding of balancing transformer 80 associated with lamp pair 40A, via a connection 100, thus being connected to one end of serial string of secondary windings 85. The second end of serial string of secondary windings 85, constituted of one end of the secondary winding of balancing transformer 80 associated with lamp pair 40K, is connected to first connection 60 of each second lamp 55, via a connection 110.

A second end of the secondary winding of driving transformer 20, constituting a second output of driving transformer arrangement 15, is connected to first connection 60 of each first lamp 50. Second connection 70 of each first lamp 50 is serially connected via the primary winding of the respective associated balancing transformer 80 to second connection 70 of the respective second lamp 55 of the lamp pair 40.

Preferably, each first lamp 50 and each second lamp 55 are constituted of a linear lamp. The end of first lamp 50 and second lamp 55 associated with first connection 60 are preferably in physical proximity of driving transformer arrangement 15, e.g. on the same side of display 90 which is typically constituted of a metal based chassis as driving transformer arrangement 15, and preferably generally define a first plane. Preferably, each first lamp 50 and each second lamp 55 generally extend axially away from the proximity of driving transformer arrangement 15, and generally define a second plane preferably orthogonal to the first plane.

In operation backlighting arrangement 400 operates in all respects similar to the operation of backlighting arrangement 10 of FIG. 1, backlighting arrangement 200 of FIG. 2, and backlighting arrangement 300 of FIG. 3, with drive energy from driving transformer 20 being supplied via serial string of secondary windings 85 to generate driving voltages at second connections 70 of first lamps 50 and second lamps 55 so as to obtain even illumination across the longitudinal dimension of the lamp. Since serial string of secondary windings 85 is connected to driving transformer 20, driving current I1 of driving transformer 20 flows through the secondary windings of the balancing transformers 80, and such current stimulates magnetic flux in the core of balancing transformers 80 thereby generating driving voltages in the primary windings of each of the balancing transformers 80.

In particular, driving current I1 is driven via connection 100 to serial string of secondary windings 85, and is returned via first connection 60 of each first lamp 50. Thus, driving current I1 exiting first connection 60 of each first lamp 50 is equal to I1/K, where K is the number of lamp pairs 40, as described above in relation to EQ. 1-EQ. 3. Similarly, current I1 received via connection 110 is split among first connection 60 of each of second lamps 55, and thus the driving current entering first connection 60 of each of second lamps 55 is equal to I1/K. Current I2, entering second connection 70 of each first lamp 50 is, assuming a turns ratio as described above, I1/K, and therefore current driven at each end is balanced. As described above, there is no requirement that a balanced current appear, and the above is simply a particular embodiment.

Thus certain of the present embodiments enable a backlighting arrangement in which a single balancing transformer is provided for each pair of lamps, the primary winding of each of the balancing transformers being arranged to be serially connected between the individual lamps of the respective pair of lamps. The secondary windings of the balancing transformers are connected in series, with a first end of the series arrangement being coupled to one lead of a driving transformer secondary providing a high voltage alternating current. In one embodiment the lamp pairs are constituted of linear lamps, one side of the linear lamps beings connected to a driving transformer and physically located nearby, the balancing transformers being connected at the side of the lamps removed from the driving transformer.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and sub combinations of the various features described hereinabove as well as variations and modifications thereof which would occur to persons skilled in the art upon reading the foregoing description and which are not in the prior art.

I claim:

1. A backlighting arrangement comprising:

a driving transformer arrangement exhibiting a first output lead and a second output lead, said first output lead and said second output lead of said driving transformer arrangement exhibiting opposing phases;

a plurality of lamp pairs, each of the constituent lamps of the plurality of lamp pairs exhibiting a first electrical connection and a second electrical connection; and a plurality of balancing transformers, each comprising a primary winding and a secondary winding magnetically coupled to said primary winding, and each associated with a particular one of said plurality of lamp pairs, the primary winding of each of said plurality of balancing transformers being serially connected between said second electrical connections of the constituent lamps of said associated lamp pair, wherein the secondary windings of said plurality of balancing transformers are serially connected in phase, with a first end of the serially connected secondary windings of said balancing transformers connected to said first output lead of said driving transformer arrangement, and said first electrical connection of at least one of the constituent lamps of each of said plurality of lamp pairs connected to said second output lead of said driving transformer arrangement.

2. A backlighting arrangement according to claim 1, wherein said driving transformer arrangement comprises a first and a second driving transformer, each exhibiting a primary winding and a secondary winding magnetically coupled thereto, the primary windings of said first and second driving transformers connected in series, with opposing ends of the serially connected primary windings of the driving transformers respectively coupled to opposing phase outputs of a driver.

3. A backlighting arrangement according to claim 2, wherein said first end of the serially connected secondary windings of said balancing transformers connected to said first output lead of said driving transformer arrangement is connected to a first end of said secondary winding of said first driving transformer, and wherein a second end of the serially connected secondary windings of said balancing transformers is connected to a first end of said secondary winding of said second driving transformer, said first end of said secondary winding of said first driving transformer out of phase with said first end of said secondary winding of said second driving transformer.

4. A backlighting arrangement according to claim 3, wherein said first electrical connection of a first lamp of each of said lamp pairs is connected to a second end of said secondary winding of said first driving transformer, and said first electrical connection of a second lamp of each of said lamp pairs is connected to a second end of said second secondary winding of said second driving transformer.

5. A backlighting arrangement according to claim 1, wherein said driving transformer arrangement comprises a first and a second driving transformer, each exhibiting a primary winding and a secondary winding magnetically coupled thereto, wherein the primary windings of said first and second driving transformers are connected in parallel to opposing phase outputs of a driver.

6. A backlighting arrangement according to claim 5, wherein said first end of the serially connected secondary windings of said balancing transformers connected to said first output lead of said driving transformer arrangement is connected to a first end of said secondary winding of said first driving transformer, and wherein a second end of the serially connected secondary windings of said balancing transformers is connected to a first end of said secondary winding of said second driving transformer, said first end of said secondary winding of said first driving transformer out of phase with said first end of said secondary winding of said second driving transformer.

7. A backlighting arrangement according to claim 6, wherein said first electrical connection of a first lamp of each of said lamp pairs is connected to a second end of said secondary winding of said first driving transformer, and said first electrical connection of a second lamp of each of said lamp pairs is connected to a second end of said second secondary winding of said second driving transformer.

8. A backlighting arrangement according to claim 1, wherein said driving transformer arrangement comprises a primary winding, a first secondary winding and a second secondary winding each magnetically coupled to said primary winding.

9. A backlighting arrangement according to claim 8, wherein said first end of the serially connected secondary windings of said balancing transformers connected to said first output lead of said driving transformer arrangement is connected to a first end of said first secondary winding of said driving transformer arrangement, and wherein a second end of the serially connected secondary windings of said balancing transformers is connected to a first end of said second secondary winding of said driving transformer arrangement, said first end of said second secondary winding out of phase with said first end of said first secondary winding.

10. A backlighting arrangement according to claim 9, wherein said first electrical connection of a first lamp of each of said lamp pairs is connected to a second end of said first secondary winding of said driving transformer arrangement, and said first electrical connection of a second lamp of each of said lamp pairs is connected to a second end of said second secondary winding of said driving transformer arrangement.

11. A backlighting arrangement according to claim 1, wherein said driving transformer arrangement is constituted of a primary winding and a single active secondary winding magnetically coupled to said primary winding.

12. A backlighting arrangement according to claim 11, wherein said first end of the serially connected secondary windings of said balancing transformers connected to said first output lead of said driving transformer arrangement is connected to a first end of said single active secondary winding of the driving transformer arrangement, and wherein a second end of the serially connected secondary windings of said balancing transformers is connected to said first electrical connection of a first lamp of each of said lamp pairs.

13. A backlighting arrangement according to claim 12, wherein said first electrical connection of a second lamp of each of said lamp pairs is connected to a second end of said secondary winding of said driving transformer arrangement.

14. A backlighting arrangement according to claim 1, further comprising a driver connected to a primary winding of said driving transformer arrangement.

15. A backlighting arrangement according to claim 1, wherein said constituent lamps of said lamp pairs are constituted of linear lamps arranged in a parallel configuration, and wherein said driving transformer arrangement is physically located associated with said first electrical connections of said constituent linear lamps.

16. A method of driving a plurality of lamp pairs, wherein each of the constituent lamps of the plurality of lamp pairs exhibit a first electrical connection and a second electrical connection, the method comprising:

providing a driving transformer arrangement;

designating a balancing transformer for each lamp pair, each of said designated balancing transformers comprising a primary winding and a secondary winding magnetically coupled thereto;

arranging the primary windings of each of said balancing transformers to be serially connected in phase between said second electrical connections of the constituent lamps of said associated lamp pair;

arranging the secondary windings of each of said balancing transformers to be serially connected in phase; and connecting a first end of the serially connected secondary windings to one output of said provided driving transformer arrangement.

17. A method according to claim 16, wherein said provided driving transformer arrangement is constituted of a first and a second driving transformer, each exhibiting a primary winding and a secondary winding, and wherein said first end of the serially connected secondary windings connected to said one output of said provided driving transformer arrangement is connected to a first end of said secondary winding of said first driving transformer, the method further comprising:

coupling the primary windings of said first and second driving transformers in series, and coupling opposing ends of the coupled primary windings to opposing phase outputs of a driver; and connecting a second end of the serially connected secondary windings to a first end of said secondary winding of said second driving transformer, said first end of said secondary winding of said first driving transformer out of phase with said first end of said secondary winding of said second driving transformer.

18. A method according to claim 16, wherein said provided driving transformer arrangement is constituted of a first and a second driving transformer, each exhibiting a primary winding and a secondary winding, and wherein said first end of the serially connected secondary windings connected to said one output of said provided driving transformer arrangement is connected to a first end of said secondary winding of said first driving transformer, the method further comprising:

coupling the primary windings of said first and second driving transformers in parallel to opposing phase outputs of a driver; and connecting a second end of the serially connected secondary windings to a first end of said secondary winding of said second driving transformer, said first end of said secondary winding of said first driving transformer out of phase with said first end of said secondary winding of said second driving transformer.

19. A method according to claim 16, wherein said provided driving transformer arrangement is constituted of a primary winding, a first secondary winding and a second secondary winding, said first and second secondary windings magnetically coupled to said primary winding, and wherein said first end of the serially connected secondary windings connected to said one output of said provided driving transformer arrangement is connected to a first end of said first secondary winding, the method further comprising:

coupling opposing ends of the primary winding of said driving transformer arrangement to opposing phase outputs of a driver; and connecting a second end of the serially connected secondary windings to a first end of said second secondary winding, said first end of said second secondary winding out of phase with said first end of said first secondary winding.

20. A method according to claim 16, wherein said driving transformer arrangement is constituted of a primary winding and a single active secondary winding magnetically coupled to said primary winding, and wherein said first end of the serially connected secondary windings connected to said one output of said provided driving transformer arrangement is connected to a first end of said single active secondary winding, the method further comprising:

coupling opposing ends of the primary winding of said driving transformer arrangement to opposing phase outputs of a driver; and coupling a second end of the serially connected secondary windings to said first electrical connection of a first lamp of each of said lamp pairs.

21. A method according to claim 20, further comprising coupling a first electrical connection of a second lamp of each of said lamp pairs to a second end of said secondary winding of said driving transformer arrangement.

* * * * *